US007147553B2

(12) United States Patent
Leask

(10) Patent No.: US 7,147,553 B2
(45) Date of Patent: Dec. 12, 2006

(54) PORTABLE SMOKING ROOM

(76) Inventor: Daniel James Leask, 3306 McMahon Road, Westbank, British Columbia (CA) V4T 1G4

( * ) Notice: Subject to any disclaimer, the term of this patent is extended or adjusted under 35 U.S.C. 154(b) by 5 days.

(21) Appl. No.: 10/991,407

(22) Filed: Nov. 19, 2004

(65) Prior Publication Data

US 2006/0111036 A1 May 25, 2006

(51) Int. Cl.
*F24F 7/007* (2006.01)

(52) U.S. Cl. ..... 454/230; 454/65; 131/240.1

(58) Field of Classification Search ..... 454/63, 454/65, 56, 341, 230; 131/240.1, 257, 242
See application file for complete search history.

(56) References Cited

U.S. PATENT DOCUMENTS 4,682,448 A * 7/1987 Healey ..... 52/63
4,732,592 A 3/1988 Spengler
4,765,352 A * 8/1988 Strieter ..... 134/99.1
4,883,512 A * 11/1989 Griffis ..... 55/356
5,074,897 A * 12/1991 Sikich ..... 55/385.2
5,181,883 A * 1/1993 Hofstra et al. ..... 454/49
5,322,473 A * 6/1994 Hofstra et al. ..... 454/186
5,407,389 A * 4/1995 Poblete et al. ..... 454/56
5,537,787 A * 7/1996 Abraham ..... 52/79.1
5,778,607 A * 7/1998 Edwards ..... 52/79.1
6,036,592 A * 3/2000 Rubin ..... 454/63
6,328,776 B1 * 12/2001 Shanks et al. ..... 55/385.2

* cited by examiner

*Primary Examiner*—Derek S. Boles
(74) *Attorney, Agent, or Firm*—Anthony C. Edwards

(57) ABSTRACT

A portable smoking room having a flexible enclosure defining a room detachably mounted on a frame is provided. A duct is detachably mounted to the frame for transporting smoke laden air within the flexible enclosure outside of the flexible enclosure. A fan detachably mounted to the duct creates negative pressure within the flexible enclosure such that smoke laden air within said flexible enclosure may be drawn out though the duct and ambient air from outside may be drawn in through a plurality of air intake apertures in the flexible enclosure. The frame of the portable smoking room may be disassembled when the enclosure and the duct are detached from the frame such that the flexible enclosure, the frame, the fan, and the duct may be transported and reassembled at another location.

8 Claims, 6 Drawing Sheets

PORTABLE SMOKING ROOM

FIELD OF THE INVENTION

The present invention relates to the field of smoking enclosures, and more particularly, it relates to a portable smoking room.

BACKGROUND OF THE INVENTION

In recent years, smoking has been prohibited in most public places including office buildings, restaurants and bars, sports arenas and theatres, and airports, mainly due to the adverse health affects associated with inhaling second hand smoke. Certain establishments have set up designated smoking areas or enclosures to allow smokers to smoke without having to step outside. However, such designated smoking areas are diminishing in numbers and the smoking enclosures currently available can be very smoke laden despite the presence of exhaust vents to remove smoke particles from the enclosures. Although the number of smokers has decreased substantially, there still exists a need for a smoking facility to accommodate the needs of smokers.

Various smoking or air cleaning modules are available in the art. For example, U.S. Pat. No. 4,732,592 to Spengler describes a portable environmental clean air facility comprising a frame wherein clear plastic sheeting material maybe draped over to form a clean air section enclosure. A bypass damper is provided for controlling the air flow velocity and for producing negative pressure in the enclosure, withdrawing contaminated air from the clean air enclosure by the blower motor. U.S. Pat. No. 5,537,787 to Abraham describes a portable smoking booth including an enclosure defining a smoking area and a purifier system that draws air from the enclosure and exhausts the air outside the enclosure. The booth is movable from one location to another location as an assembled unit and the wall and door of the booth is clear to enable a prospective user of the booth to view activity outside the booth. However, none of the smoking or clean air modules provides an easily transportable smoking room that enables a user to smoke a cigarette virtually wherever and whenever the user desires. Consequently, there exists a need for a portable and collapsible smoking room to enable a user to conveniently transport and assemble such room so that the user may smoke a cigarette at an appropriate indoor location.

SUMMARY OF THE INVENTION

It is therefore an object of the present invention to provide a portable smoking room wherein the smoking room may be disassembled and conveniently transported to a different location where the portable smoking room may be reassembled for use.

In accordance with the present invention, there is provided a portable smoking room having a flexible enclosure detachably mounted to a frame, the flexible enclosure defining a room having a door. A first flexible duct is detachably mounted to the frame such that air within the flexible enclosure may be transported outside of the flexible enclosure. A fan detachably mounted to the first air duct creates negative pressure within the flexible enclosure such that air within the flexible enclosure may be drawn out though the first flexible duct. The frame may be disassembled when the flexible enclosure and the first duct are detached from the frame such that the flexible enclosure, the frame, the fan, and the first duct may be conveniently transported and reassembled at a different location.

The portable smoking room may also include a first mounting bracket detachably secured to the frame such that a first end of the first flexible duct may be detachably mounted to the mounting bracket. A second end of the first flexible duct is detachably mounted to an intake end of a fan such that the fan may withdraw smoke laden air from the enclosure. Preferably, the fan is an inline fan. A first end of a second flexible duct is detachably mounted to an exhaust end of the fan such that smoke laden air within the flexible enclosure may be directed outside the flexible enclosure. Preferably, the second end of the second duct is detachably mounted to a second mounting bracket which is detachably mounted to a window such that the smoke laden air within the flexible enclosure may be transported outdoors.

In an embodiment of the invention, the door of the enclosure defines a plurality of apertures such that the fan may draw ambient air outside the flexible enclosure into the flexible enclosure. Preferably, the door is at least partially transparent such that a user inside the enclosure may view activity outside the flexible enclosure. The flexible enclosure also defines an aperture such that the first end of the first duct may be inserted through the aperture so that it may be detachably mounted to the first mounting bracket.

In another embodiment of the invention, the frame, the enclosure, the first and the second ducts, the fan, and the first and said second mounting brackets may be disposed within a container such that the portable smoking room may be conveniently transported to another location for reassembly.

In another embodiment of the invention, the portable smoking room includes a light fixture detachably mounted to the frame. An actuator for activating the fan and the light fixture may be detachably mounted to the frame.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EMBODIMENTS OF THE INVENTION

Figure 1:
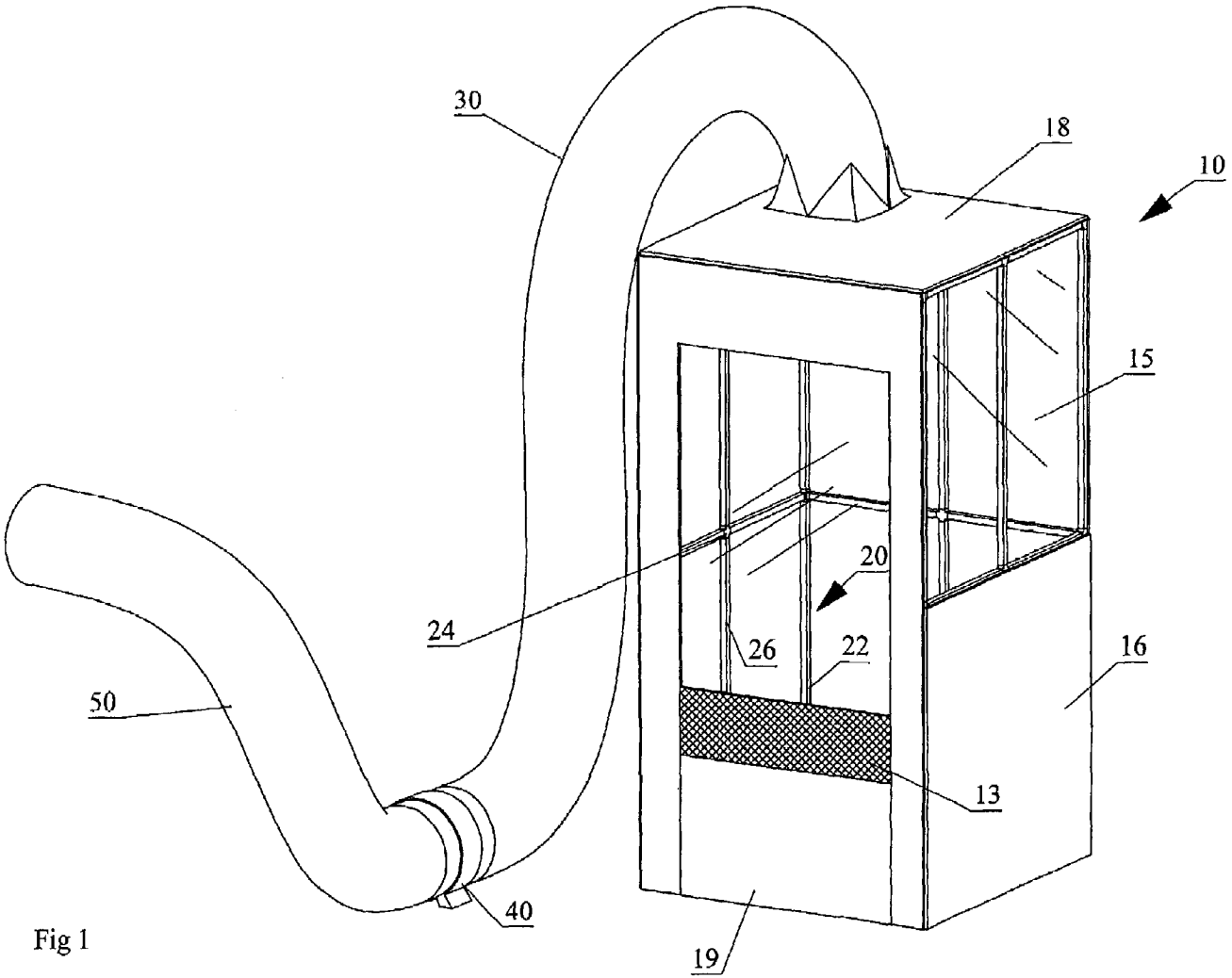
FIG. 1 is a side perspective view of the smoking room according to the present invention.
Figure 2:
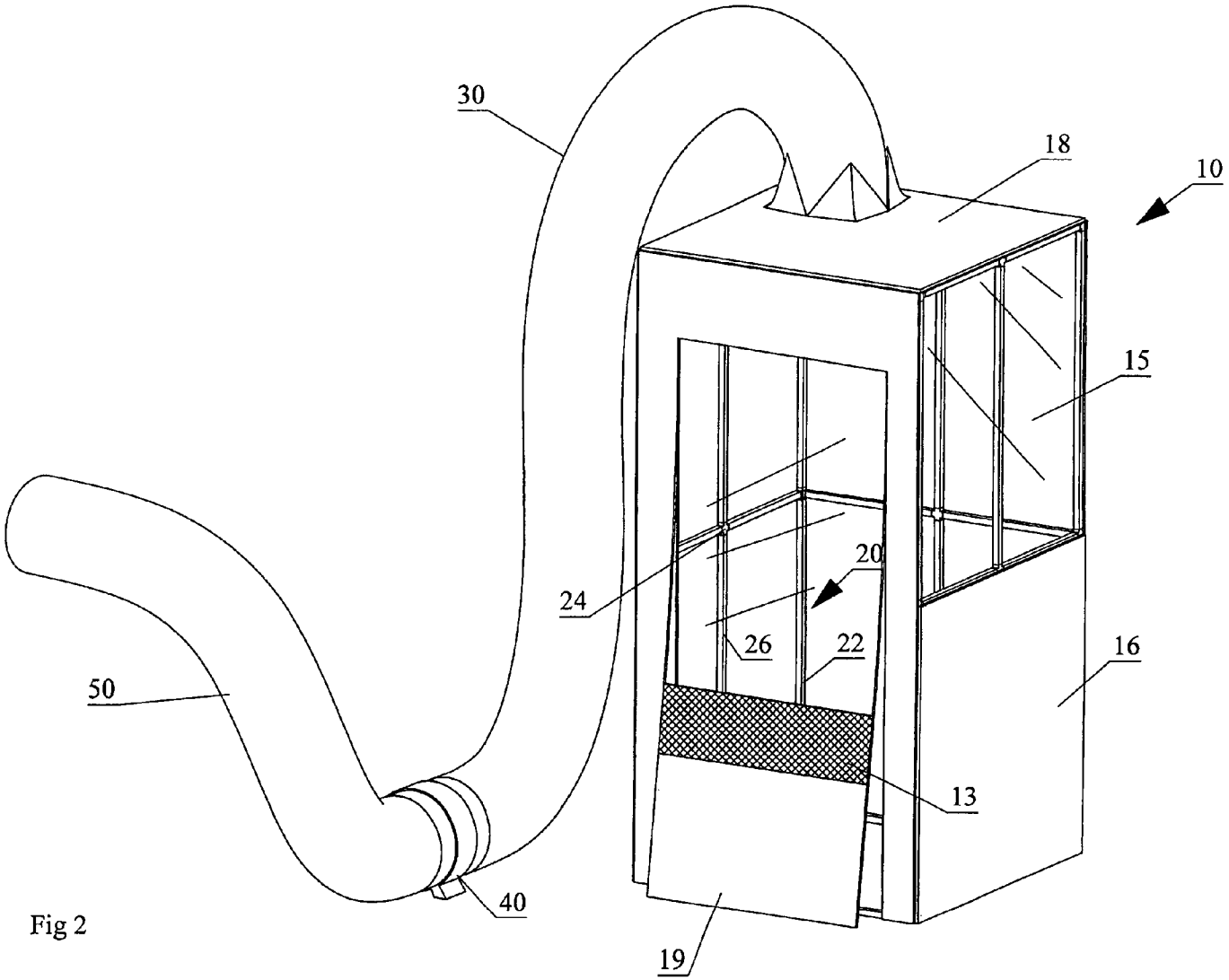
FIG. 2 is a side perspective view of the smoking room shown in FIG. 1 wherein the door is selectively accessible.
Figure 3:
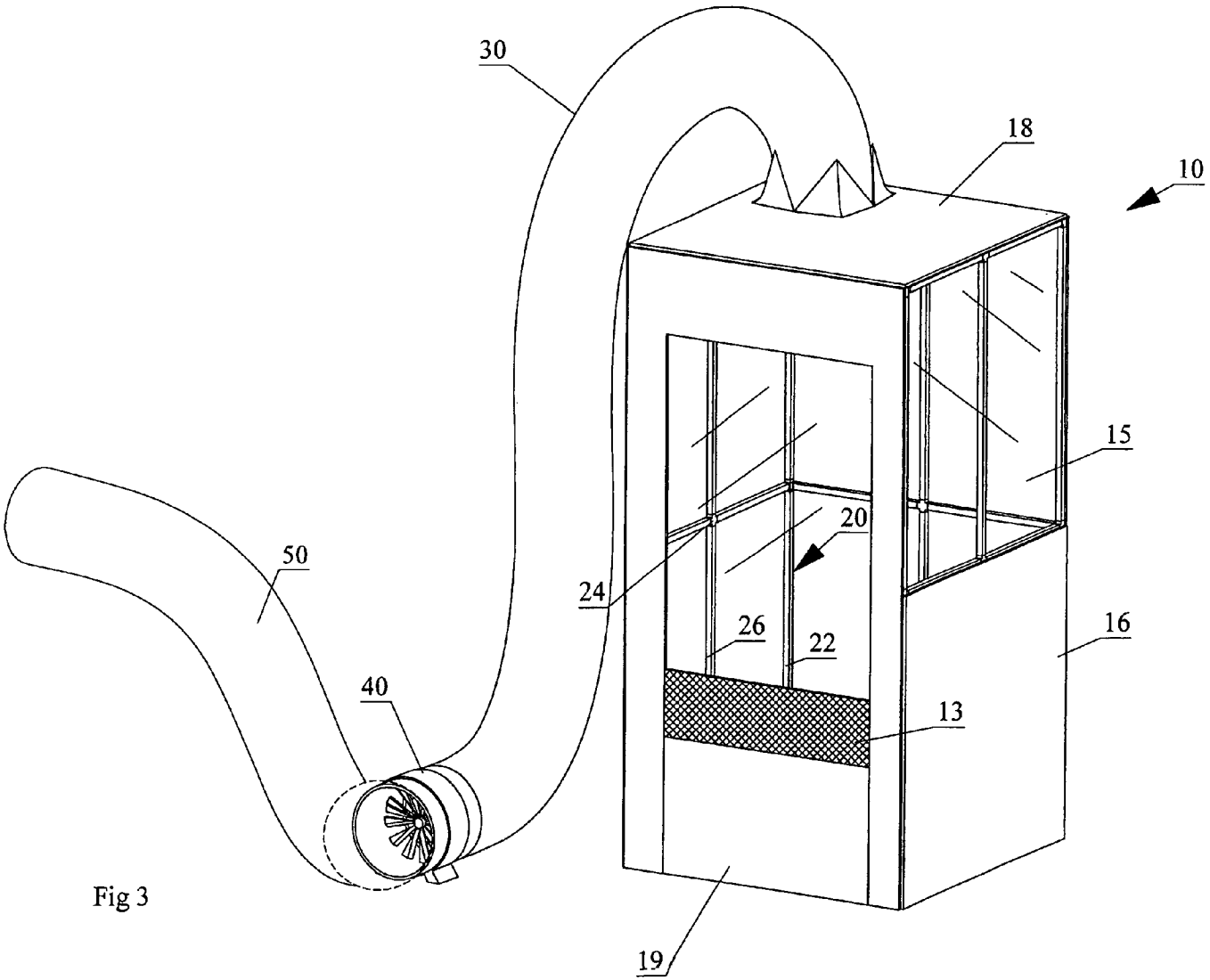
FIG. 3 is an exploded side perspective view of the flexible duct attached to the fan.
Figure 4:
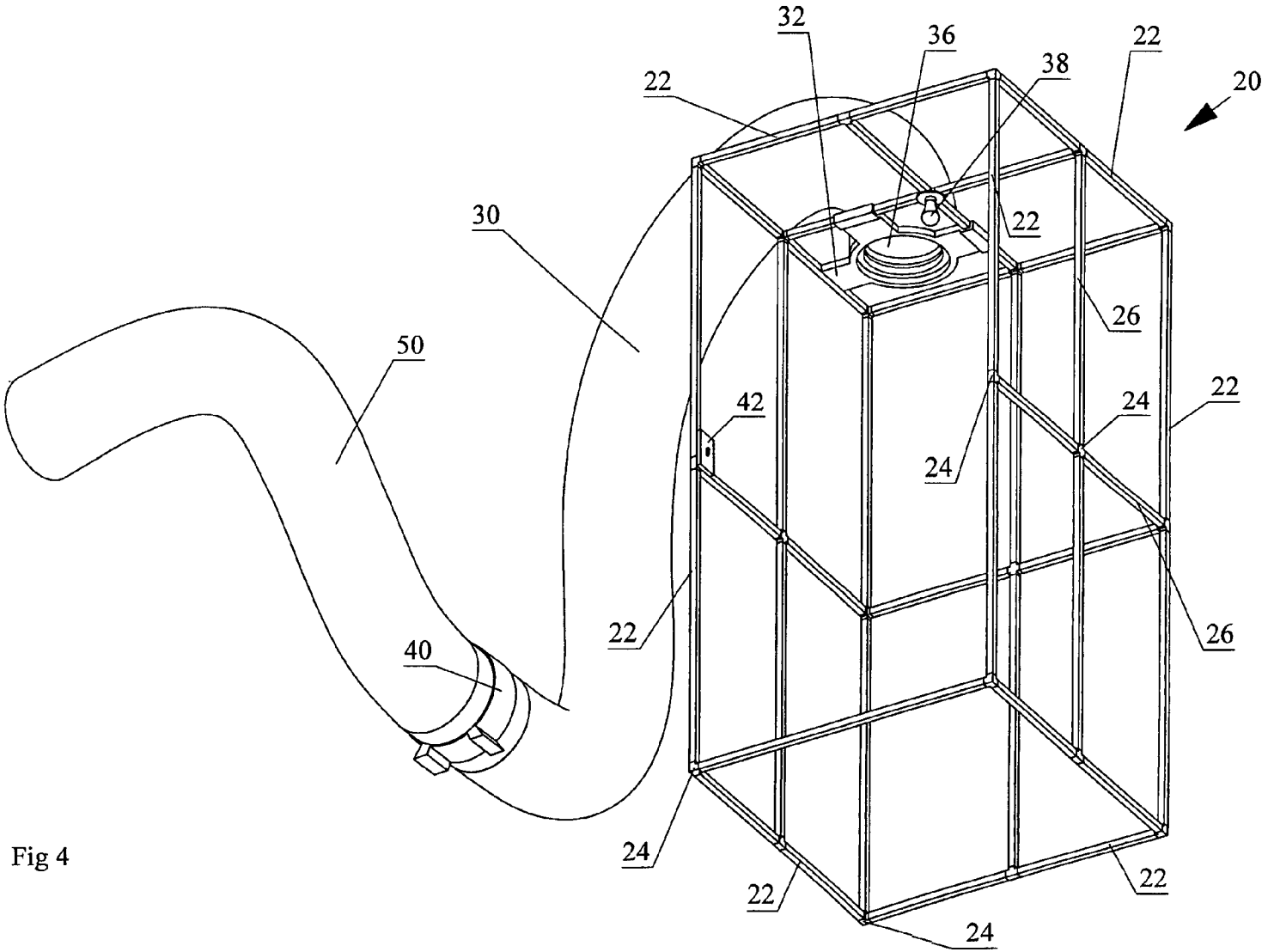
FIG. 4 is a side perspective view of the frame of the smoking room shown in FIG. 1.
Figure 5:
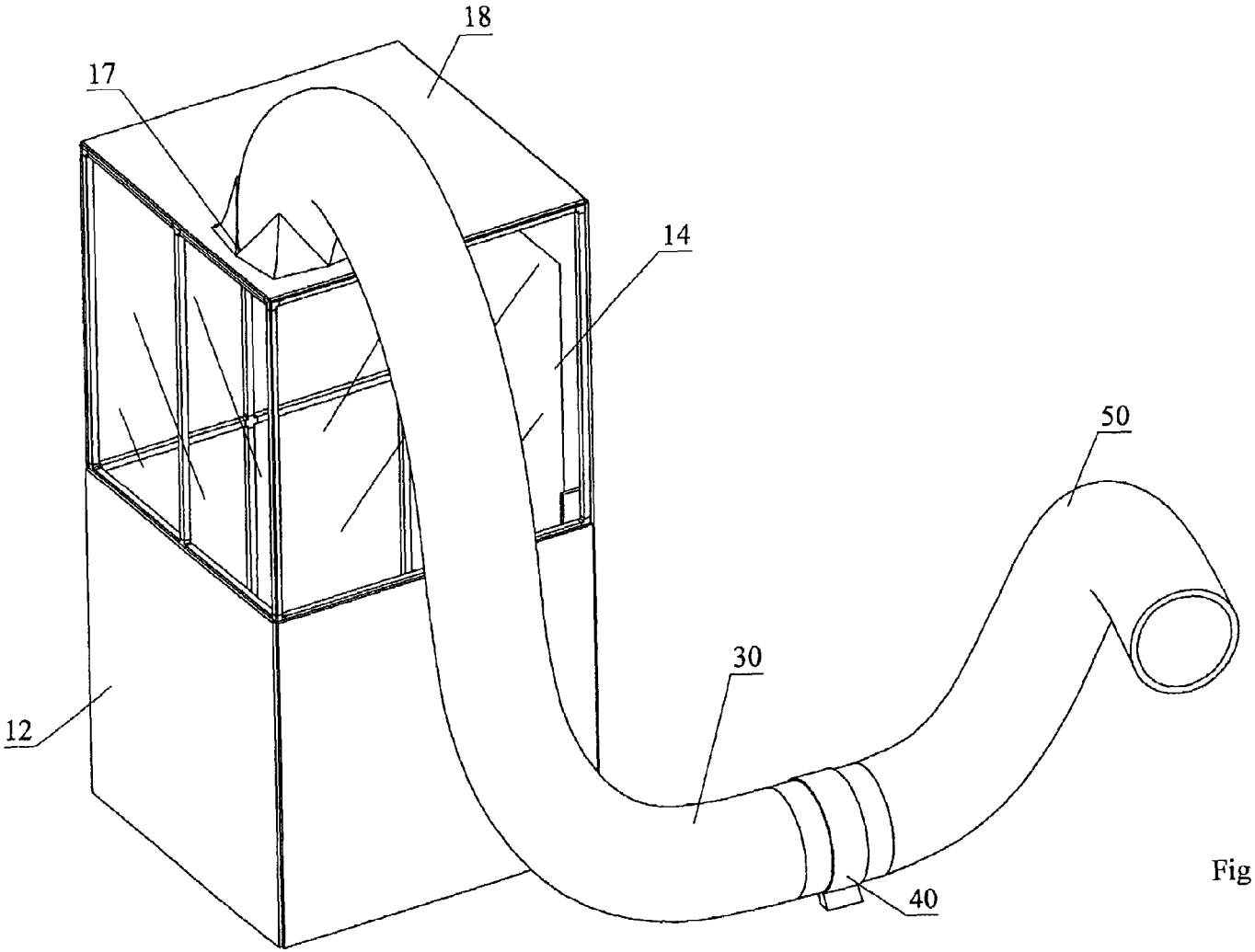
FIG. 5 is a rear perspective view of the frame of the smoking room shown in FIG. 1.
Figure 6:
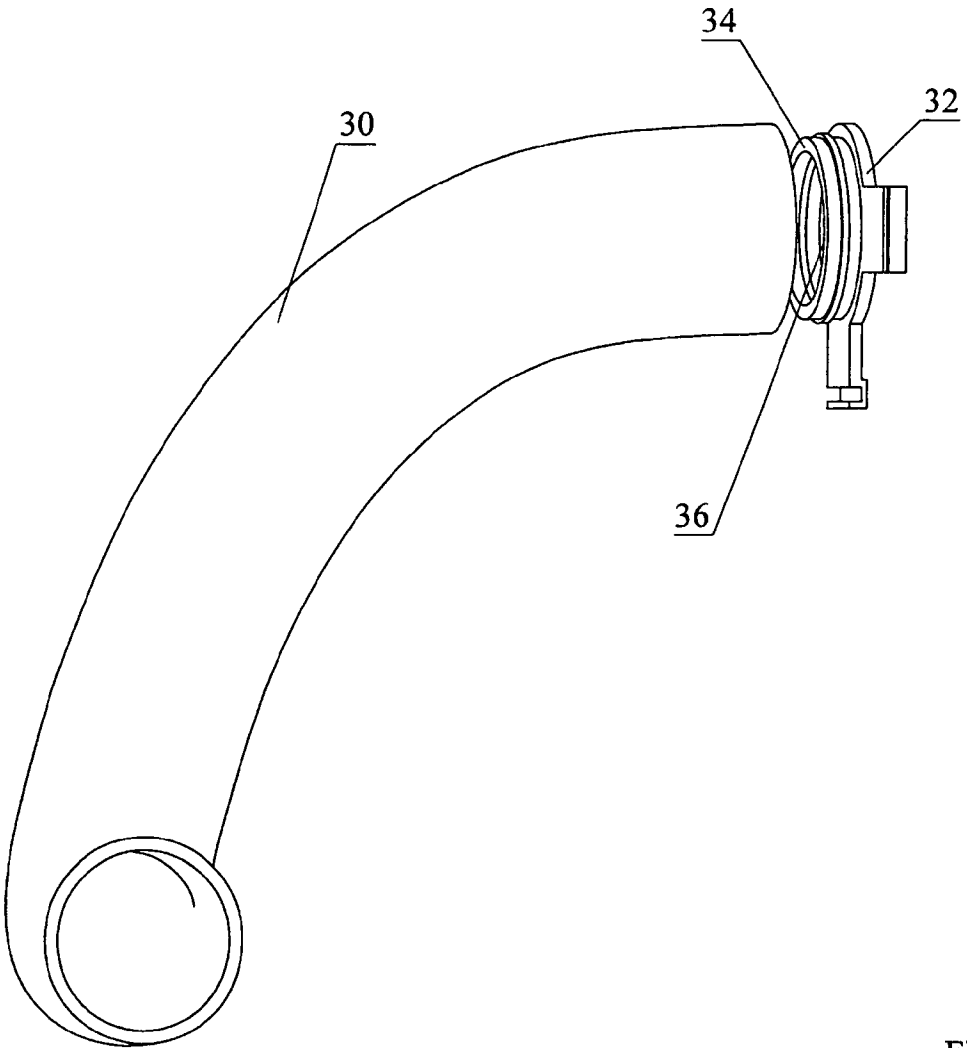
FIG. 6 is an exploded side view of the flexible duct and the mounting bracket.

With reference to FIGS. 1 to 6 wherein similar characters of reference denote corresponding parts in each view, the portable smoking room according to the present invention includes a flexible enclosure 10 detachably mounted on a frame 20. Frame 20 may be disassembled for convenient and compact transport or storage when flexible enclosure 10 is detached from frame 20. A first flexible air duct 30 is detachably secured to frame 20 at a first end and detachably mounted to an intake end of fan 40 at a second end such that negative pressure may be created within enclosure 10 to withdraw smoke laden air from enclosure 10. A first end of a second flexible air duct 50 is detachably mounted to an exhaust end of fan 40 such that air withdrawn from within enclosure 10 through first air duct 30 due to the negative pressure maybe transported outside enclosure 10 into the open air outdoors.

In an embodiment of the invention, the smoking room is generally rectangular in shape and sized to accommodate at least one user, although the smoking room may be any shape and constructed to accommodate a plurality of users. In an embodiment of the invention, the smoking room measures seven feet in height and three and a half feet in width and in depth. Frame 20 may be made of any lightweight and durable material such as aluminium, steel, or plastic. In an embodiment of the invention, frame 20 is made of plastic tubing having a plurality of frame sections 22 that may be detachably joined to each other to form frame 20. Frame sections 22 may be detachably joined by any connecting means such as conventional slip fit joints 24 wherein ends of frame sections 22 may be detachably inserted into joints 24 for ease of assembly and disassembly. Joints 24 may be formed integrally at the ends of frame sections 22 or joints 24 may be independent members. Preferably, all the frame sections 22 may be detached from each other such that frame 20 may be fully disassembled and conveniently and compactly disposed within a container for transport and/or storage. Frame 20 may also include a plurality of support sections 26 that may be detachably joined to frame sections 22 by similar connecting means described above to provide additional structural support to frame 20.

Frame 20 further includes a mounting bracket 32 that may be detachably secured to frame 20 such that the first end of first air duct 30 may be detachably attached to mounting bracket 32. Mounting bracket 32 may be positioned in between and detachably secured to any of the frame sections 22 and support sections 26 by conventional securing means such as screws or clamps. In an embodiment of the invention, mounting bracket 32 includes three sleeves configured to frictionally engage frame section 22 and support sections 26 in a snap on manner. Mounting bracket 32 may be made of the same material as frame 20. An annular flange 34 on mounting bracket 32 defines an aperture 36 corresponding to the circumference of first air duct 30 such that the first end of first air duct 30 may be detachably mounted in mating engagement with annular flange 34. Mounting bracket 32 may include a plurality of retaining means such as clips to assist in securing first air duct 30 to mounting bracket 32.

Flexible enclosure 10 may be made of any lightweight fabric or sheeting material such as nylon or vinyl. The lightweight fabric or sheeting material may be detachably mounted on frame 20 by conventional attaching means such as snap fasteners or VELCRO hook and loop strip fasteners to form a sealed enclosure. In an embodiment of the invention flexible enclosure 10 is made of canvas and includes a rear panel 12, opposing side panels 14 and 16, a top panel 18, and a front panel 19. Preferably, rear panel 12, opposing side panels 14 and 16 and top panel 18 are made of the same material and front panel 19 is made of a transparent plastic sheeting to enable the user within flexible enclosure 10 to see outside the smoking room. Alternatively, rear panel 12, opposing panels 14 and 16, top panel 18 and front panel 19 may all be made of the same material. In an embodiment of the invention, front panel 19 is a door that may be selectively accessed to enable a user to step into flexible enclosure 10. Preferably, front panel 19 includes a plurality of apertures 13 such that ambient air outside flexible enclosure 10 may be drawn inside flexible enclosure 10 by fan 40. Preferably, top panel 18 has or defines an aperture 17 wherein the first end of first air duct 30 maybe insertable through aperture 17 so that first end of first air duct 30 may be detachably mounted to mounting bracket 32 on top of frame 20. Alternatively, opposing panel 14 or 16 may define aperture 17 such that first end of first air duct 30 may be detachably mounted to the side of frame 20. In a preferred embodiment of the invention, the upper portion of opposing panel 14 and/or 16 and/or rear panel 12 may include windows 15 made of the same transparent plastic sheeting as door 19 to enable the user within flexible enclosure 10 to see outside the smoking room. In another embodiment of the invention, additional panels of the same lightweight fabric or sheeting material as enclosure 10 may be detachably mounted by similar attaching means described above to the interior of frame 20 such that frame 20 may not be seen by the user when the user is inside the smoking room.

In an embodiment of the invention, fan 40 is an inline fan which may be positionable anywhere outside enclosure 10 so long as, in cooperation with duct 30, the fan creates negative pressure within enclosure 10 such that smoke laden air within enclosure 10 may be drawn out through first air duct 30 and released outdoors through second air duct 50. Outdoors is herein defined as the open air outside any building or enclosure wherein the smoking room may be positioned. Negative pressure exists when less air is supplied to a space than is exhausted from the space. The plurality of apertures 13 defined by front panel 19 enables air outside of enclosure 10 to flow into enclosure 10. When fan 40 is activated, enclosure 10 becomes a negatively pressurized space because less air is flowing into enclosure 10 through apertures 13 than is being exhausted from enclosure 10 through first air duct 30 and second air duct 50. Fan 40 places a slight suction within enclosure 10 and draws fresh air in through apertures 13 on front panel 19 to replace the extracted contaminated air. Preferably, fan 40 may be actuated by a switch 42 detachably mounted to frame 20 inside enclosure 10.

First air duct 30 and second air duct 50 may be any conventional flexible air duct available in the art capable of performing low to high pressure residential or commercial applications. The length of first and second air ducts 30 and 50 may vary depending on where the user wants to position the smoking room. The second end of first air duct 30 is preferably configured such that it may be detachably mounted in mating engagement with the intake end of fan 40. Similarly, the first end of second air duct 50 is preferably configured such that it may be detachably mounted in mating engagement with the exhaust end of fan 40. Securing means such as detachable clips, clamps, and screws may be provided to help secure the second end of first air duct 30 and the first end of second air duct 50 to the intake and exhaust end of fan 40, respectively. In an embodiment of the invention, a second mounting bracket similar to first mounting bracket 32 may be provided. The second mounting bracket may be secured to a window frame such that the second end of second air duct 50 may be detachably mounted to the second mounting bracket to direct the smoke laden air outdoors.

In another embodiment of the invention, the top of frame 20 includes a conventional light fixture 38 for illuminating the interior of enclosure 10. Light fixture 38 may be detachably mounted to frame 20. Preferably, light fixture 38 is configured such that light fixture 38 and fan 40 may be simultaneously actuated by switch 42.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A portable smoking room comprising:

a flexible enclosure defining a substantially enclosed free-standing room having a door, said enclosure detachably mounted on a frame;

a mounting bracket detachably secured to said frame;

a duct having a first end and a second end, said first end of said duct detachably mounted to said mounting bracket, said duct transporting air within said flexible enclosure outside of said flexible enclosure;

a fan having an intake end and an exhaust end, said second end of said duct detachably mounted to said intake end of said fan, said fan creating negative pressure within said flexible enclosure such that air within said flexible enclosure may be drawn out though said duct; and wherein said frame may be disassembled when said enclosure and said duct are detached from said frame such that said flexible enclosure, said frame, said fan, said duct, and said mounting bracket may be transported and reassembled.

2. The portable smoking room of claim 1 wherein said mounting bracket is mounted to a top of said frame.

3. The portable smoking room of claim 2 wherein said enclosure is at least partially transparent and has a plurality of air intake apertures such that said fan may draw ambient air from outside said flexible enclosure into said flexible enclosure.

4. The portable smoking room of claim 3 wherein at least one side panel of said flexible enclosure is partially transparent.

5. The portable smoking room of claim 4 wherein said flexible enclosure has an aperture such that said first end of said duct may be inserted through said aperture to be detachably mounted to said mounting bracket.

6. The portable smoking room of claim 5 wherein said fame, said enclosure, said duct, said fan, and said mounting bracket may be disposed within a container such that the portable smoking room may be transported.

7. The portable smoking room of claim 6 further comprising a light detachably mounted to said frame.

8. The portable smoking room of claim 7 further comprising an actuator for activating said fan and said light.

* * * * *